US008371260B2

(12) United States Patent
Baker et al.

(10) Patent No.: US 8,371,260 B2
(45) Date of Patent: Feb. 12, 2013

(54) CYLINDER HEAD DRAIN AND VENT

(75) Inventors: Rodney E. Baker, Fenton, MI (US); Roxann M. Bittner, Bloomfield Hills, MI (US); Brian W. Geiser, Ortonville, MI (US); Pamela A. Sinnott, Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 228 days.

(21) Appl. No.: 12/841,249

(22) Filed: Jul. 22, 2010

(65) Prior Publication Data

US 2011/0277721 A1 Nov. 17, 2011

Related U.S. Application Data

(60) Provisional application No. 61/345,384, filed on May 17, 2010.

(51) Int. Cl.
*F01M 9/10* (2006.01)

(52) U.S. Cl. ..... 123/193.5; 123/572

(58) Field of Classification Search ..... 123/196 R, 123/193.5, 90.27, 90.33, 572–574, 41.86, 123/294

See application file for complete search history.

(56) References Cited

U.S. PATENT DOCUMENTS

| | | | | | |
|---|---|---|---|---|---|
| 4,771,745 | A * | 9/1988 | Nakamura et al. | ..... | 123/196 R |
| 4,951,622 | A * | 8/1990 | Takahashi et al. | ..... | 123/193.5 |
| 5,845,616 | A * | 12/1998 | Schwarzenthal et al. | .. | 123/90.33 |
| 6,138,633 | A * | 10/2000 | Prior | ..... | 123/196 R |
| 6,257,188 | B1 * | 7/2001 | Fujii et al. | ..... | 123/90.38 |
| 6,631,701 | B2 * | 10/2003 | Seader et al. | ..... | 123/90.34 |
| 7,987,830 | B2 * | 8/2011 | Kim | ..... | 123/90.33 |
| 2010/0229819 | A1 * | 9/2010 | Kuhlbach et al. | ..... | 123/193.5 |

FOREIGN PATENT DOCUMENTS

| | | | |
|---|---|---|---|
| DE | 69103117 | T2 | 12/1994 |
| DE | 19614825 | A1 | 4/1997 |
| DE | 10138698 | A1 | 3/2002 |
| EP | 0445355 | B1 | 2/1997 |
| JP | 2009236084 | A | 10/2009 |
| KR | 100215406 | B1 | 5/1999 |

* cited by examiner

*Primary Examiner* — M. McMahon

(74) *Attorney, Agent, or Firm* — Quinn Law Group, PLLC

(57) ABSTRACT

A central direct injection (DI) cylinder head is configured with an intake valvetrain and an exhaust valvetrain separated by an uncovered central DI valley. The uncovered central DI valley limits oil flow from the high side chamber to the low side chamber and PCV transfer. Oil drainage and additional PCV transfer between the intake and exhaust chambers is provided by drain/vent passages integrally cast into the casting of the cylinder head. The drain/vent passages may be of varying configuration, and may be located between an injector port of a first cylinder set and a spark plug port of an adjacent cylinder set, or at either or both ends of the cylinder head. A method is provided to form a casting of the cylinder head as described herein, including casting of a plurality of drain/vent passages between the first chamber and the second chamber of the cylinder head.

11 Claims, 7 Drawing Sheets

CYLINDER HEAD DRAIN AND VENT

CROSS-REFERENCE TO RELATED APPLICATIONS

This application claims the benefit of U.S. Provisional Patent Application No. 61/345,384 filed May 17, 2010, and which is hereby incorporated by reference in its entirety.

TECHNICAL FIELD

The present invention relates to drainage and venting of a cylinder head.

BACKGROUND

A central direct injection (DI) engine cylinder head is typically configured with an intake valvetrain and an exhaust valvetrain separated by a central valley including the injectors and spark plugs. Connecting the intake and exhaust chambers to allow drainage and ventilation between the chambers is very difficult due to the head configuration required for central DI. A cylinder head cover may provide an opening over the central valley such that the central valley is uncovered providing access to the injectors and spark plugs, which may limit ventilation and oil drainage between the intake and exhaust chambers and through the head cover. Limited oil drainage between the high side and low side chambers may result in excess oil accumulation, insufficient oil cooling and increased potential for oil coking. Providing oil circulation, drainage and ventilation passages between the chambers may require oil management and circulation systems configured external to the cylinder head, increasing oil system demand, engine cost, complexity, and packaging space requirements.

SUMMARY

A central direct injection (DI) engine cylinder head is configured with an intake valvetrain and an exhaust valvetrain separated by an uncovered central valley including the injectors and spark plugs. The cylinder head is further configured for integrated exhaust. The cylinder head cover is configured to seal the intake and exhaust chambers while providing an opening over the central valley such that the central valley is uncovered providing access to the injectors and spark plugs and for packaging of other components, including a central DI rail. Ventilation between the intake and exhaust chambers above the surface of the cylinder head chambers and through the head cover may be limited to a rear passage which may be of significantly reduced cross-sectional area due to engine packaging constraints. The configuration of the uncovered central DI valley may limit oil drainage across the cylinder head surfaces between the high side and low side chambers.

A cylinder head with integrated drain/vent passages configured to provide drainage of oil and PCV transfer between the high side and low side chambers of the cylinder head is provided. The cylinder head includes a first side defining a first chamber, a second side defining a second chamber and a central portion defining a valley which substantially separates the first chamber from the second chamber. The cylinder head further includes a plurality of passages, wherein each of the plurality of passages is configured to transfer fluids including exhaust gas and lubricating fluid between a first chamber and a second chamber, including, for example, draining oil from a first chamber to a second chamber.

A method is provided to form the cylinder head as described herein, wherein the cylinder head is formed by casting the head including a plurality of drain/vent passages between a first chamber and a second chamber of the cylinder head. The cast cylinder head is configured with a central DI valley separating a first chamber and a second chamber and the method of casting includes assembling a core assembly including a first core, a second core and a third core. The first core is configured to define the central DI valley of the cylinder head, and the second core is configured to define a plurality of passages between the first chamber and the second chamber, wherein each of the plurality of passages is configured to communicate with the first chamber and the second chamber of the cylinder head. The third core is configured to define a water jacket. The cylinder head is cast from one of aluminum or cast iron using the core assembly.

The above features and other features and advantages of the present invention are readily apparent from the following detailed description of the best modes for carrying out the invention when taken in connection with the accompanying drawings.

DETAILED DESCRIPTION

Figure 1:
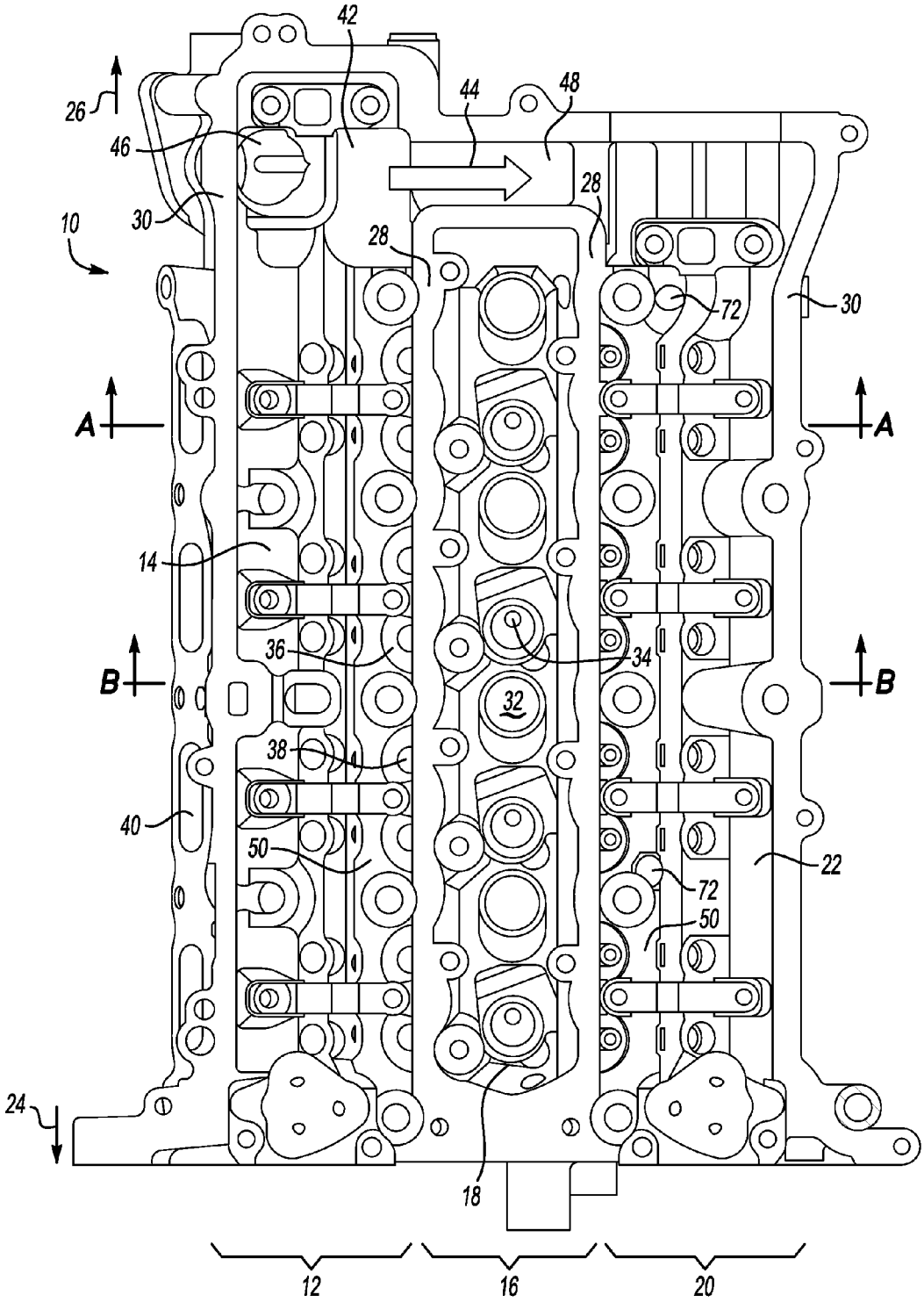
FIG. 1 is a schematic top view of a cylinder head configured for central direct injection.

Referring to the drawings wherein like reference numbers represent like components throughout the several figures, and beginning with FIG. 1, a schematic top view of a partially assembled cylinder head is generally indicated at 10. Cylinder head 10 is formed as a casting, typically of aluminum or cast iron and may be additionally finished by machining, grinding or other processes. Cylinder head 10, which may also be referred to as head 10, is configured to include a first side 12 and a second side 20, which are generally oriented from the front 24 to the rear 26 of head 10 along the longitudinal axis of head 10 and are separated by a center portion 16. A first chamber 14 is defined by first side 12 of head 10 and a second chamber 22 is defined by second side 20 of head 10.

A center portion 16 defines a valley 18 which extends generally along the longitudinal axis of the cylinder head and substantially separates chamber 14 from chamber 22. A plurality of injector ports 34 and a plurality of spark plug ports 32, where the ports are shown in FIG. 1 in their as cast condition, are located in valley 18. The injector ports 34 and spark plug ports 32 are alternated in locations along the valley 18 such that a set comprising an injector port and a spark plug port are located to correspond to each set of valves for each cylinder of the cylinder head. The perimeter of valley 18 is defined by an inner sealing rail 28, which provides a sealing surface for a cylinder head cover. The cylinder head cover is open in its central portion, such that valley 18 remains uncovered by the head cover inside of the perimeter defined by inner sealing rail 28.

Figure 2:
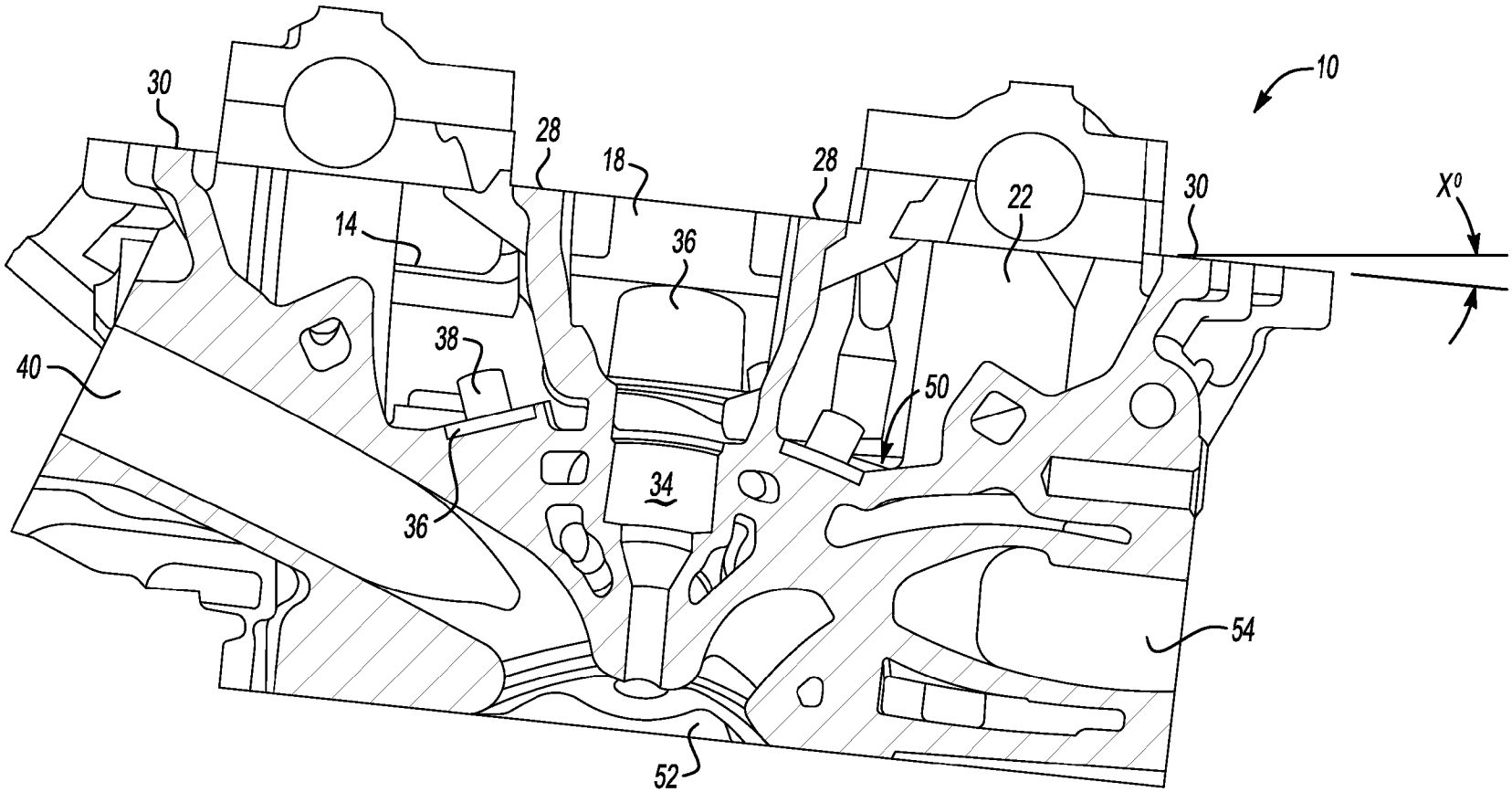
FIG. 2 is a schematic cross-sectional view of section A-A of FIG. 1 with the cylinder head oriented as installed in a vehicle, showing the center valley cross-sectioned through a fuel injector port.

In the configuration shown in FIG. 1, first side 12 is the intake side of head 10 and first chamber 14 is the intake chamber of head 10; and second side 20 is the exhaust side of head 10 and second chamber 22 is the exhaust chamber of head 10. Referring now to FIG. 2, a cross-sectional view taken at line A-A of FIG. 1 is shown, illustrating the center valley cross-sectioned through a fuel injector port 34. The orientation of cylinder head 10 when installed in an engine in a vehicle is also shown in additional detail where, as installed in vehicle orientation, head 10 is tilted or rotated about its longitudinal axis by X degrees off horizontal, such that intake side 12 is higher than exhaust side 20. In this orientation, intake side 12 is referred to as the high side of head 10, and exhaust side 20 is referred to as the low side, where high side 12 is tilted X degrees above horizontal and low side 20 is tilted X degrees below horizontal. In a non-limiting example configuration, cylinder head 10 is tilted approximately 9 degrees off horizontal, with the intake side 12 tilted higher than exhaust side 20. In an installed configuration on an engine and in a vehicle, the horizontal plane can be defined as a plane parallel with the plane established by the wheels of the vehicle in contact with the ground upon which the vehicle sits in a normal orientation.

Referring again to FIG. 1 and FIG. 2, chambers 14 and 22 extend generally along either side of valley 18. The lower (in an as installed orientation) surface of each chamber 14, 22 defines a spring deck 50 which includes a plurality of spring seats 36. Each spring seat 36 includes a valve guide 38. The upper (in an as installed orientation) surface of head 10 includes an outer sealing rail 30, which generally extends around the outside perimeter of head 10, and further includes an inner sealing rail 28. The inner sealing rail 28, as discussed previously, is located along the perimeter of valley 18. Inner sealing rail 28 and outer sealing rail 30 provide the sealing surfaces against which a cylinder head cover (not shown) is affixed and therebetween define the area of cylinder head 10 enclosed and covered by the cylinder head cover.

As shown in FIG. 1, an upper deck surface 42 includes an orifice 46. Orifice 46 is a mounting hole for a fuel pump and fuel pump tappet/roller follower (not shown). A passage 48 is defined by at least a portion of upper deck surface 42 and a cylinder head cover affixed to head 10 at seal rails 28, 30.

The cylinder head cover (not shown) is configured with an outside edge which generally conforms with outer sealing rail 30 and an inside edge which generally conforms to the inner sealing rail 28, such that the cylinder cover is configured with an open center portion defined by the inside edge. When assembled on head 10, the cylinder cover seals against rails 28 and 30 to enclose the intake and exhaust chambers and a connecting upper deck surface 42, leaving valley 18 unenclosed by the cylinder cover. The cylinder cover is of sufficient height to enclose the cams, valve stems, rocker arms and other components which are assembled in head 10 and which may protrude above (in an as installed orientation) the upper surface of head 10. The cylinder cover may be decreased in height or partially recessed in the area corresponding to a portion of upper deck 42 and drain/vent passage 48, for packaging considerations. For example, the DI fuel rail positioned over valley 18 may extend from the rear of the cylinder head through the recessed area of the cylinder cover, or the cylinder head cover may be of decreased height or recessed to package the connection from the fuel pump to the DI fuel rail.

Sealing the surface of head 10 with a cylinder cover having an open center portion configured to leave valley 18 uncovered such that the intake chamber and exhaust chamber are connected at the head surface by drain/vent passage 48, which may be of limited height and cross-section due to packaging constraints, substantially limits the area for flow of oil and ventilation breathing from one chamber to another through the cylinder cover. Referring again to FIG. 2, shown in a cross-sectional view of chambers 14 and 22 and valley 18 which further illustrates the separation of chamber 14 and chamber 22. FIG. 2 shows a section taken through the injector port 34 above cylinder opening 52. Oil accumulating in the lower portion of chamber 14 will accumulate on the lower surface of spring deck 50 of chamber 14 around spring seat 36 and valve guide 38. As illustrated, there is no drainage path for oil to flow from high side chamber 14 to low side chamber 22. Further, there is no ventilation path through the cylinder cover in the section shown from chamber 14 across valley 18 to chamber 22 when the cylinder head cover is installed. As discussed previously, the head cover is configured with a central open portion, such that the cover is sealed in a first portion from outer sealing rail 30 at the outer perimeter of chamber 14 to inner sealing rail 28 at the inner perimeter of chamber 14, and is sealed in a second portion from outer sealing rail 30 at the outer perimeter of chamber 22 to inner sealing rail 28 at the inner perimeter of chamber 22.

As shown in FIGS. 1 and 2, cylinder head 10 is configured for integrated exhaust and includes a plurality of intake ports 40, exhaust ports 54 and positive crankcase ventilation (PCV) vents 56 (see FIG. 3) such that head 10 also functions as an exhaust manifold. PCV transfer between the intake and exhaust chambers is required for proper operation and breathing of the engine. As described herein, a plurality of drain/vent passages 62 (see FIG. 3) are provided in head 10 in communication with intake chamber 14 and exhaust chamber 22 to supplement PCV transfer between intake chamber 14 and exhaust chamber 22 and therefore provide additional breathing for the engine, and to address the limited cross-chamber ventilation resulting from the central DI packaging.

To minimize wear and for smoothness of operation, lubrication must be provided to the moving and interfacing parts, such as the cams, valves, rocker arms, tappets, etc., within the chambers of the cylinder head. The lubricant, also referred to as lubricating fluid is typically, for example, motor oil or a synthetic or semi-synthetic lubricant or oil. Referring again to FIG. 1, oil present in the cylinder head flows in a direction 44 generally from intake side 12 toward exhaust side 20. The oil flows in a direction 44 due to gravity and the orientation of cylinder head 10 when installed in an engine, e.g., cylinder head 10 is tilted off horizontal in an installed position, as shown in FIG. 2. Oil continuously supplied to head 10 from an engine oil system (not shown) may accumulate, for example, in chambers 14 and 22, and excess oil must be drained from these areas for recirculation through the engine oil system and to prevent overheating of the oil which may cause oil coking. As shown in FIG. 1, excess oil accumulating in exhaust chamber 22 may be drained, for example, through oil drain holes 72. Oil flow from intake (high) side 12 to exhaust (low) side 20 and drain holes 72 located therein is limited on the surfaces of head 10 to oil flow occurring across upper deck surface 42 via upper drain passage 48. In an as installed orientation, excess oil accumulating in intake chamber 14 primarily accumulates at a level below upper deck surface 42, therefore, the oil flowing across upper deck surface 42 and through upper drain passage 48 is primarily oil provided for the lubrication of a fuel pump tappet and cam in communication with a fuel pump (not shown) and mounting hole 46. A means to drain excess oil from chamber 14 to chamber 22 is therefore required. As described herein, a plurality of drain/vent passages 62 (see FIG. 3) are provided in head 10, such that excess oil accumulating at spring deck 50 of chamber 14 can be drained into chamber 22 and from cylinder head 10 through drain holes 72, thus avoiding the cost, complexity and packaging difficulties of adding drain holes to high side intake chamber 14.

Figure 3:
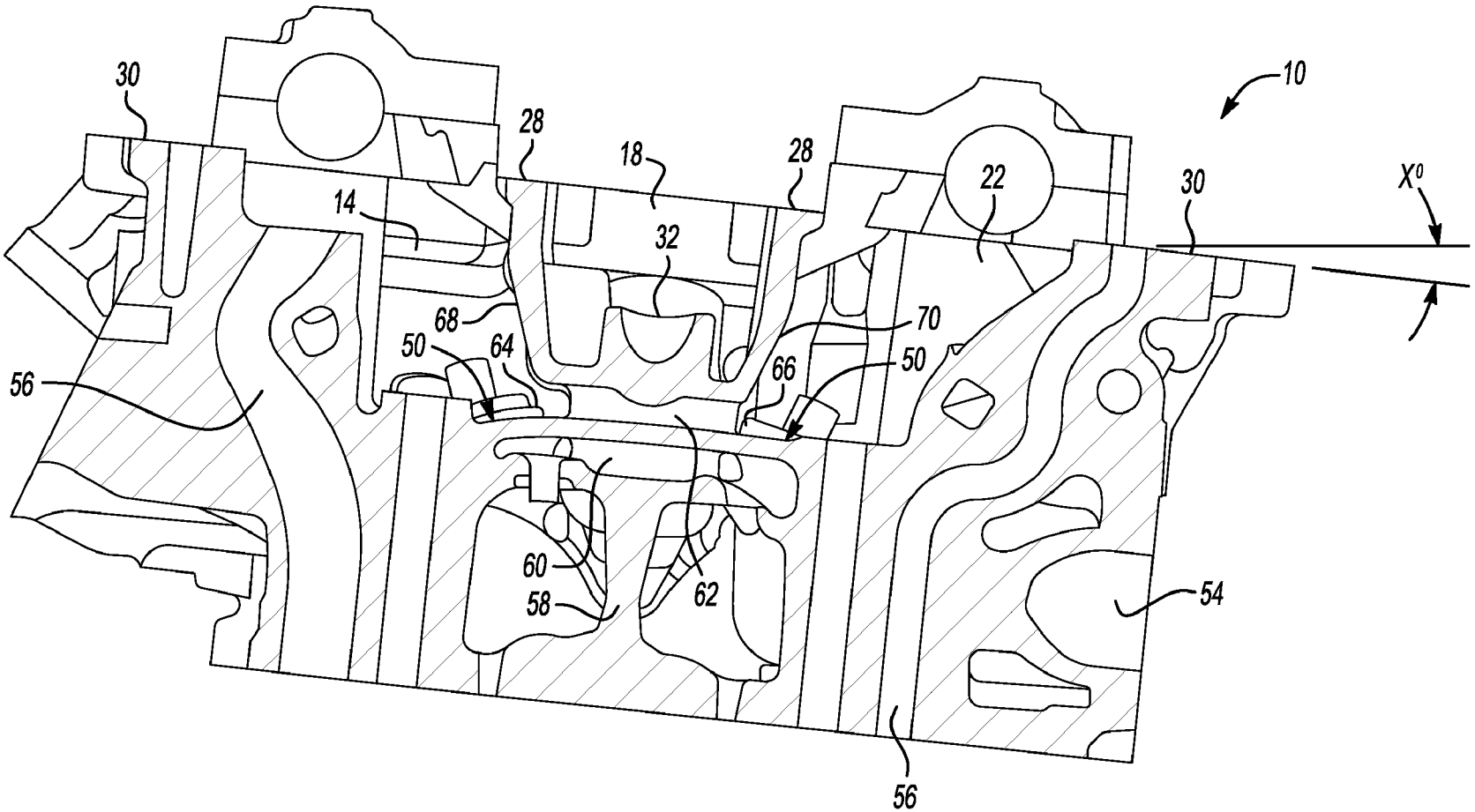
FIG. 3 is a schematic cross-sectional view of section B-B of FIG. 1 with the cylinder head oriented as installed in a vehicle, showing the center valley cross-sectioned between a fuel injector port and a spark plug port and a drain/vent passage between the chambers.

Referring now to FIG. 3, a cross-sectional view of section B-B of FIG. 1 with cylinder head 10 oriented as installed in a vehicle is shown. Center valley 18 is shown cross-sectioned between a fuel injector port 34 (not shown) of a first cylinder and a spark plug port 32 of a second and adjacent cylinder. Also shown and further described herein is a drain/vent passage 62 in communication with intake chamber 14 and exhaust chamber 22, which allows drainage of oil and PCV transfer from one chamber to another. An intake passage opening 64 is defined by a portion of interior intake chamber wall 68 and intake side spring deck 50. An exhaust passage opening 66 is defined by a portion of interior exhaust chamber wall 70 and exhaust side spring deck 50. In an as installed orientation, oil drains from the spring deck area of intake chamber 14 through passage 62 to exhaust chamber 22, where, as discussed previously, it may be drained through drain holes 72 to the engine oil supply system for recirculation. PCV ventilation may also occur through passage 62 providing additional breathing from first chamber 14 to second chamber 22 for the engine.

Drain/vent passage 62 is an integrated passage formed during the casting of cylinder head 10, using a method described herein. Passage 62 as shown in FIG. 3, for example, is located above a section of a water jacket 58, which is also formed during casting of cylinder head 10 and travels from chamber 14 to chamber 22 between a fuel injector port 34 of a first cylinder and a spark plug port 32 of an adjacent cylinder. A first section of cylinder head 10 separates passage 62, as shown in FIG. 3, from water jacket 58 and a second section of cylinder head 10 separates passage 62 from valley 18.

A plurality of drain/vent passages 62 may be formed in cylinder head 10 to connect the chambers 14, 22 of cylinder head 10. The plurality of drain/vent passages 62 may vary in configuration and location. For example, in additional to drain/vent passages 62 located between the cylinder sets, a drain/vent passage 62 may be located in the front end portion of head 10, connecting the front end of chamber 14 to the front end of chamber 22. Another drain/vent passage 62 may be located in the rear end portion of head 10, connecting the rear end of chamber 14 to the rear end of chamber 22.

Figure 4:
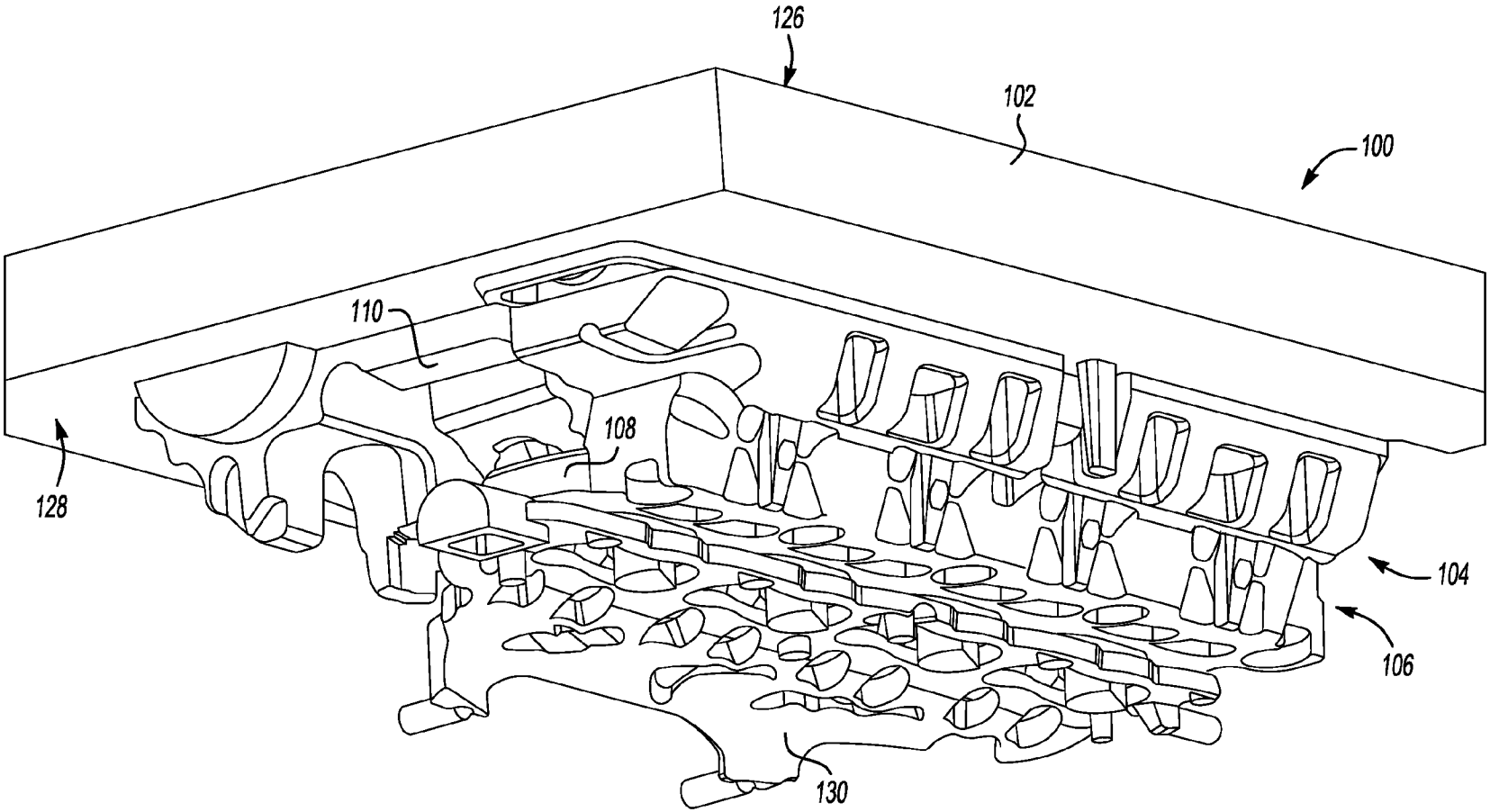
FIG. 4 is a schematic perspective illustration of a core assembly used in casting the cylinder head of FIG. 1 including the drain/vent passages.

FIG. 4 is a schematic perspective illustration of a core assembly used for a method of casting the cylinder head 10 of FIG. 1, including casting drain/vent passages 62. Generally indicated at 100 is a core assembly consisting of a first core 102 referred to as a cope core, a second core 104 including a lower core portion 106 referred to as a spring deck/drain/vent core, and a third core 130 referred to as an upper water jacket core, where second core 104 is sandwiched or positioned between first core 102 and third core 130 during the casting process. It is understood that core assembly 100 would be used with other die components in casting head 10. The top of cope core 102 is indicated at 126, and the bottom of cope core 102 is indicated at 128. These are intended as references applicable to orientation of the cores and core assembly generally, e.g., the same directional designation of top and bottom apply to each core in the core assembly, and to the core assembly. Each core surface or portion of core surface may define a cast surface, a portion of a cast surface or a combination of cast surfaces of the casting of cylinder head 10. For example, the bottom portion 128 of cope core 102 defines the interior cast surface of valley 18 including the spark plug ports 32 and injector ports 34. A combination of cores may define an internal or external section of the casting of head 10. For example, cope core 102 and second core 104, at section 110, define the corresponding top deck surface portion 42 and drain vent 48. As another example, the top surface of upper water jacket core 130 in combination with the bottom surface lower core portion 106 of spring deck/drain/vent core 104 define the generally horizontal internal section between the generally horizontal passage 60 of water jacket 58 and passage 62 shown in FIG. 3.

As shown in FIG. 4, second core 104 generally defines the interior surface of first and second chambers 14 and 22. Lower core portion 106 of second core 104, also referred to as a spring deck/drain/vent core defines the lower portion of the interior surface of chambers 14 and 22, e.g., spring deck surfaces 50 including spring seats 36, valve guides 38 and interior wall portions 68, 70 adjacent to spring deck 50. Lower core portion 106 in combination with upper water jacket core 130 defines passage openings 64 and 66, and in further combination with cope core 102 defines drain/vent passages 62.

Figure 5A:
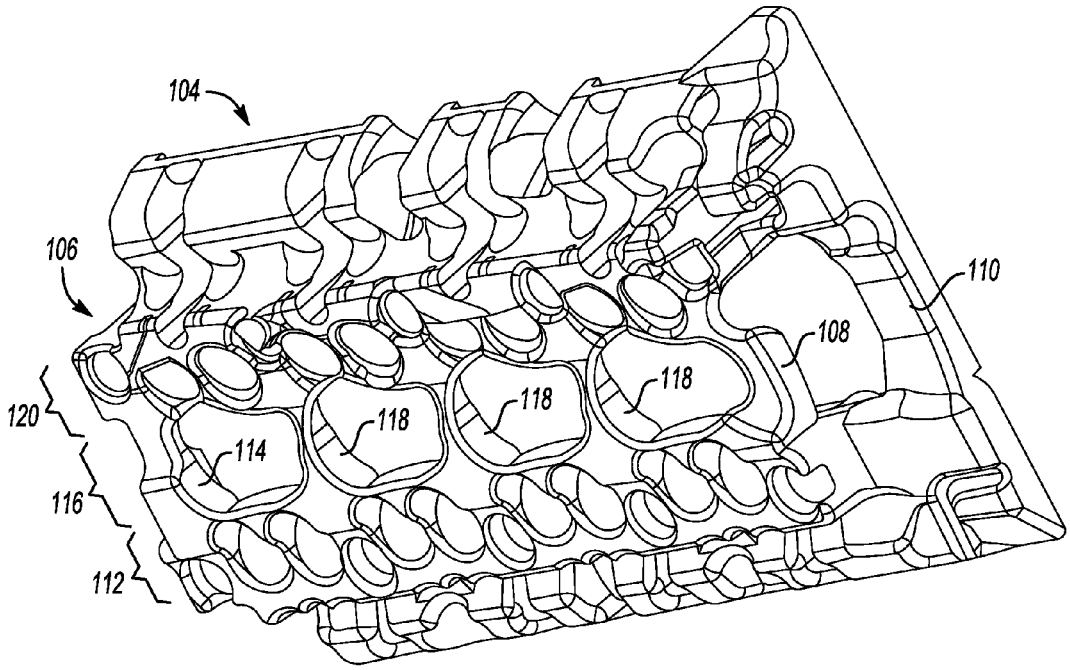
FIG. 5A is a perspective bottom view of a core of the core assembly of FIG. 4, defining the drain/vent passages of the cylinder head of FIG. 1.
Figure 5B:
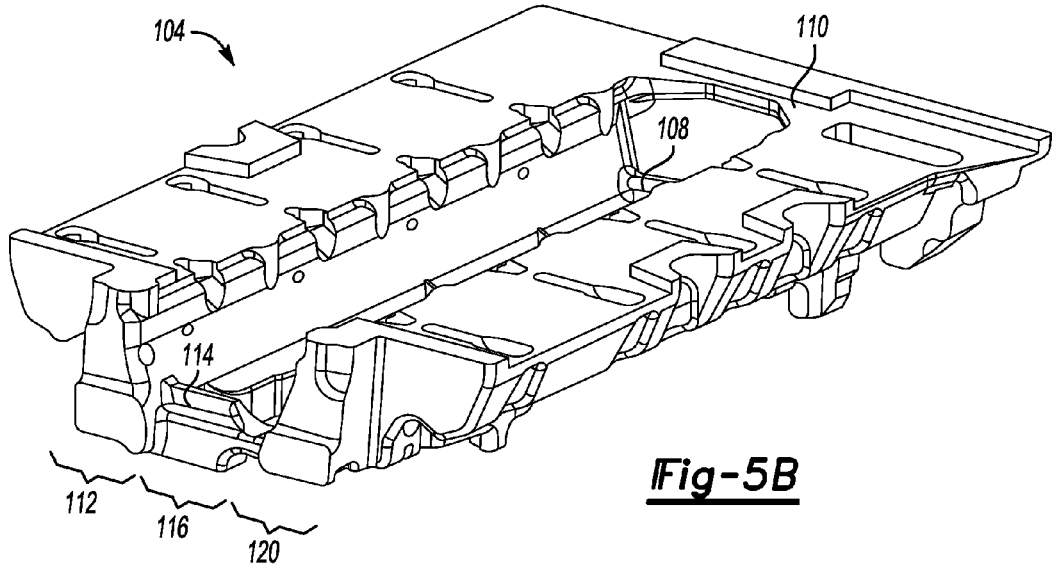
FIG. 5B is a perspective top view of a core of the core assembly of FIG. 4, defining drain/vent passages of the cylinder head of FIG. 1.

Referring now to FIGS. 5A and 5B, shown is a schematic perspective bottom view of core 104 including lower core portion 106 defining drain/vent passages 62 of cylinder head 10. As discussed previously, lower core portion 106 defines spring deck surfaces 50 and interior wall portions 68, 70. For reference and orientation of core 104 to the casting of head 10, a first side 112 of core 104 is indicated which corresponds to intake side 12 and chamber 14 of head 10, and a second side 120 of core 104 is indicated which corresponds to exhaust side 20 and chamber 22 of head 10. A central portion 116 of core 104 corresponds to central portion 16 of head 10.

As shown in FIGS. 5A and 5B, sections 118 of central portion 116 of lower core portion 106 define a plurality of passages 62 and their respective passage openings 64, 66. The plurality of passages 62 which correspond to the plurality of core sections 118 are those passages 62 which are located generally between adjacent cylinders in head 10 and which are illustrated by FIG. 3. Sections 118 may vary in configuration, including thickness, height, cross-section and shape, as required for the specific configuration of cylinder head 10, and as required for consideration of other factors including casting considerations such as shrinkage, porosity and microstructure control and design considerations such as wall thickness and strength, thermal stability and machining stock requirements.

Also shown in FIGS. 5A and 5B are core sections 114 and 108. Core section 114 corresponds to and defines a passage 62 including its passage openings 64, 66 located in the front portion of the casting of head 10. Passage 62 defined by section 114 provides a connecting passage for oil flow and PCV transfer between the front end of intake chamber 14 and the front end of exhaust chamber 22. Core section 108 corresponds to and defines a passage 62 including its passage openings 64, 66 located in the rear portion of the casting of head 10. Passage 62 defined by section 108 provides a connecting passage for oil flow and PCV transfer between the rear end of intake chamber 14 and the rear end of exhaust chamber 22. Core sections 114 and 108 may be configured differently from each other and core sections 118, as discussed previously, in consideration of the design, process and functional requirements of head 10.

Figure 6A:
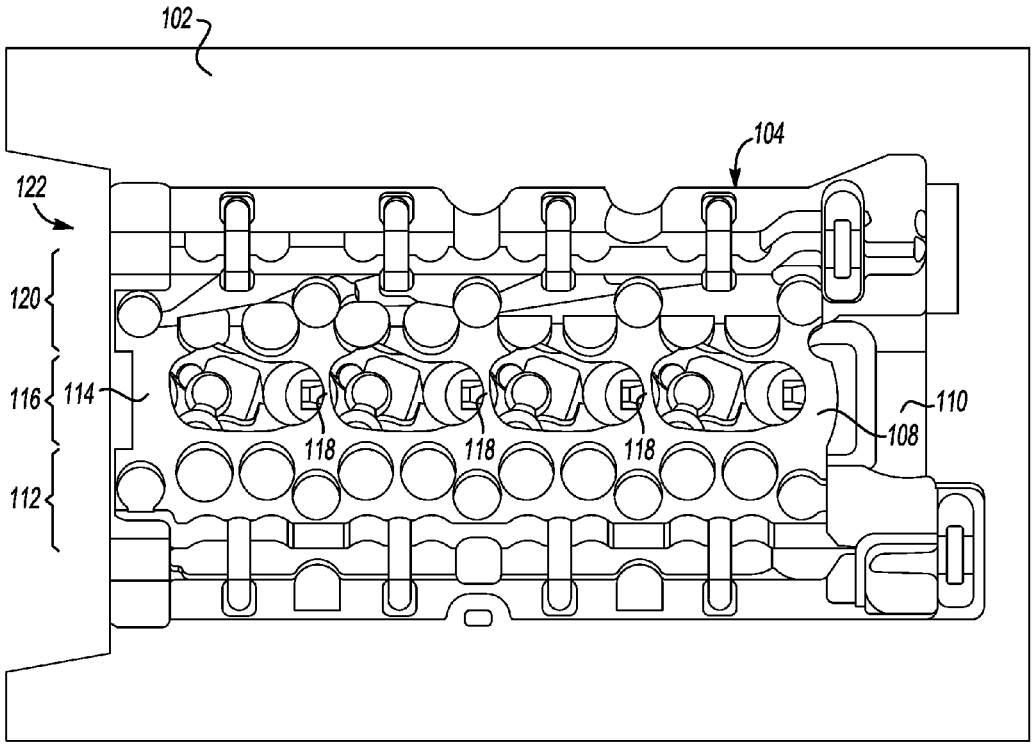
FIG. 6A is a schematic bottom view of a core sub-assembly of the core assembly of FIG. 4.
Figure 6B:
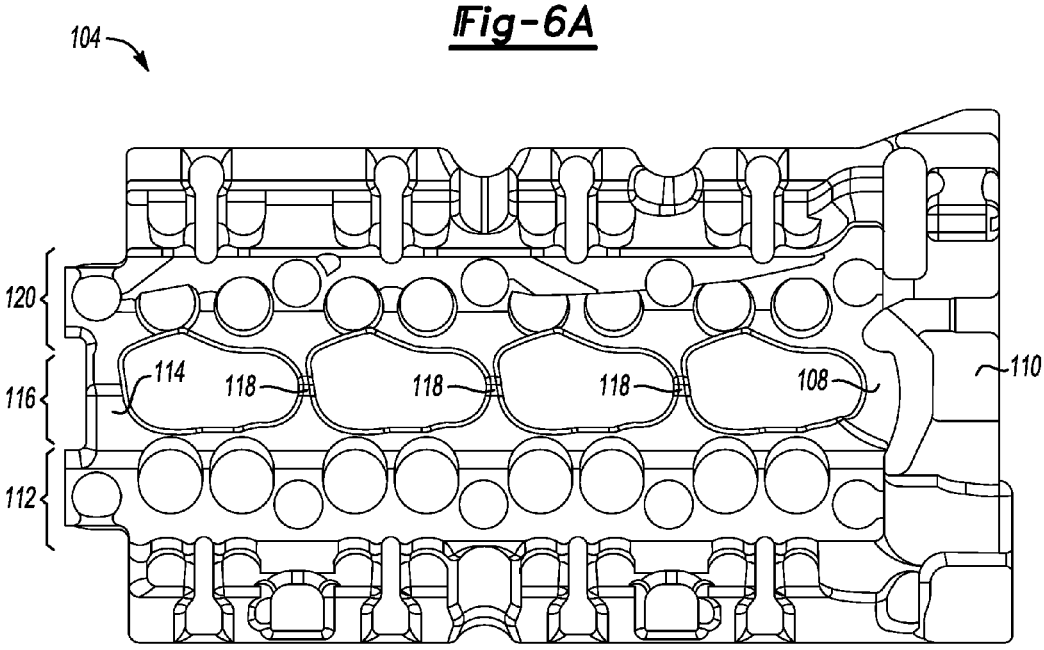
FIG. 6B is a bottom view of a core of the core sub-assembly of FIG. 6A.
Figure 7A:
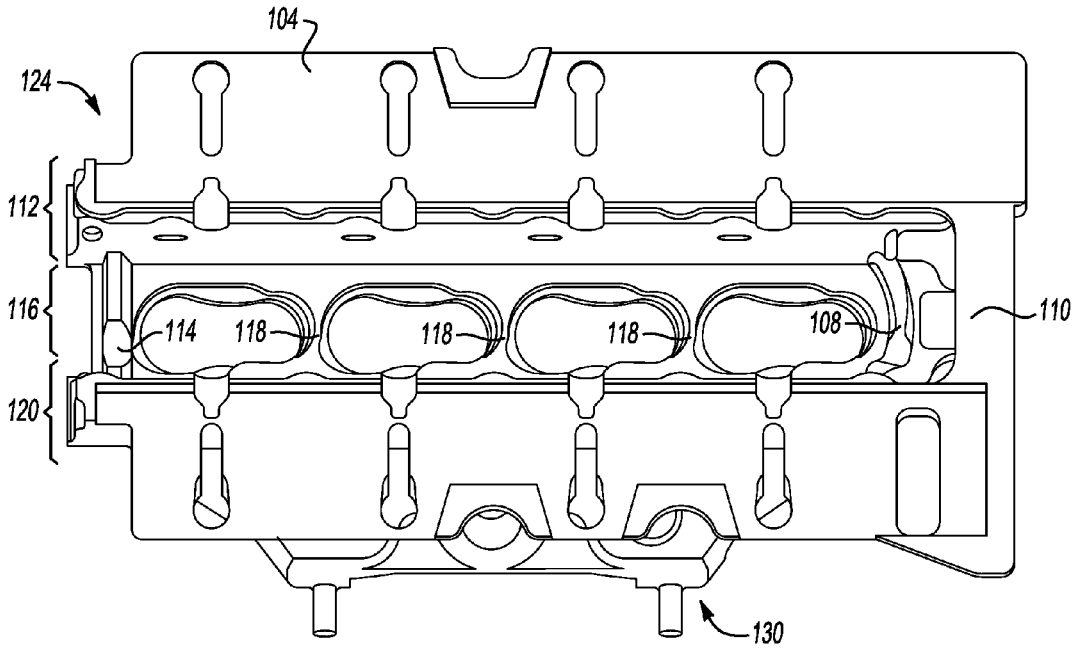
FIG. 7A is a schematic top view of a core sub-assembly of the core assembly of FIG. 4.
Figure 7B:
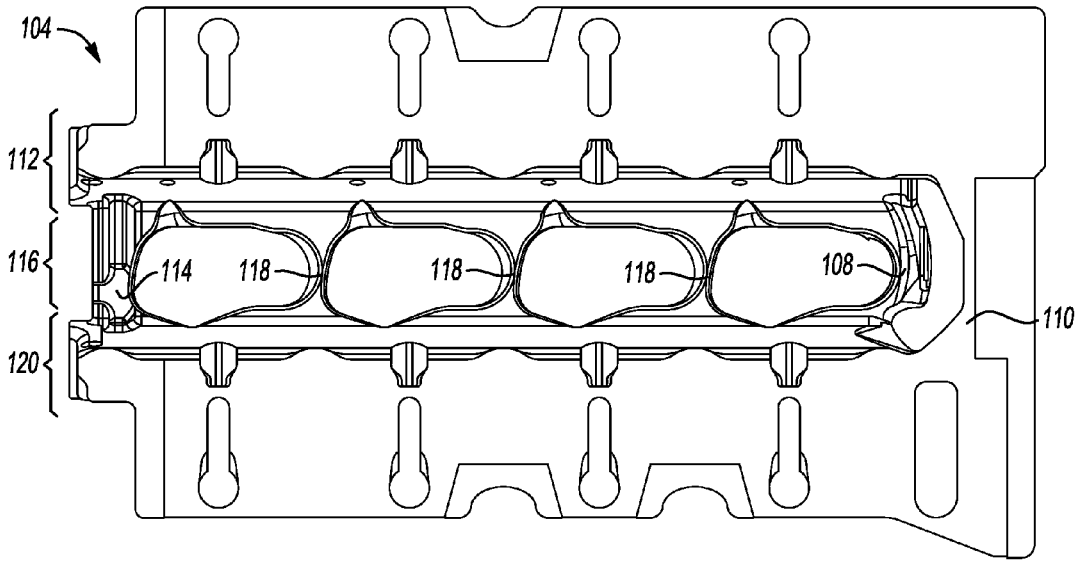
FIG. 7B is a top view of a core of the core sub-assembly of FIG. 6A.

Additional views of the cores and sub-assemblies of the cores are provided in FIGS. 6A, 6B, 7A and 7B to further illustrate the orientation of one core to another in core assembly 100 and to further illustrate core sections 108, 114 and 118 corresponding to passages 62 in cylinder head 10. Referring to FIG. 6A, a bottom view of a core sub-assembly 122 consisting of cope core 102 and second core 104 is shown. FIG. 6B provides a bottom view of second core 104. Referring now to FIG. 7A, a top view of a core sub-assembly 124 consisting of second core 104 and upper water jacket core 130, and FIG. 7B provides a top view of second core 104 of the core sub-assembly of FIG. 6A.

The advantages of integrally casting drain and vent passages in a compact cylinder head as described herein include, for example, improved oil drainage and PCV transfer between cylinder head chambers, additional engine breathing, reduction in oil system complexity, engine packaging efficiency, and reduced cost. Those familiar with the art will recognize the invention as described herein is not limited to an engine cylinder head configured for central DI and may be practiced for other cylinder head configurations or configurations with similar design and performance requirements and constraints.

While the best modes for carrying out the invention have been described in detail, those familiar with the art to which this invention relates will recognize various alternative designs and embodiments for practicing the invention within the scope of the appended claims.

The invention claimed is:

1. A cylinder head comprising:

a first side defining a first chamber;

a second side defining a second chamber;

a central portion defining a valley;

wherein the valley substantially separates the first chamber from the second chamber;

a plurality of passages defined by the cylinder head;

wherein each of the plurality of passages is configured to transfer fluid between the first chamber and the second chamber: and wherein one of the plurality of passages is configured to drain fluid from the first chamber to the second chamber.

2. The cylinder head of claim 1, wherein the fluid is one of a lubricating fluid and crankcase ventilation gas.

3. The cylinder head of claim 1, wherein the cylinder head is adaptable for use in a central direct injection engine.

4. The cylinder head of claim 1, wherein the first chamber and the second chamber are sealed by a cover; and wherein the valley is not sealed by the cover.

5. The cylinder head of claim 1, wherein the plurality of passages is configured to at least partially define an exhaust manifold.

6. The cylinder head of claim 1, wherein one of the plurality of passages is further configured to transfer crankcase ventilation gas between the first chamber and the second chamber.

7. The cylinder head of claim 1, wherein one of the plurality of passages is located between a fuel injector port and a spark plug port.

8. The cylinder head of claim 7, wherein the fuel injector port and the spark plug port are adjacent to each other.

9. The cylinder head of claim 7, wherein the fuel injector port is the fuel injector port of a first cylinder set; and wherein the spark plug port is the spark plug port of a second cylinder set.

10. The cylinder head of claim 1, wherein one of the plurality of passages is located in an end portion of the cylinder head.

11. The cylinder head of claim 1, wherein the cylinder head is formed from one of aluminum and cast iron.

* * * * *